US009506623B2

(12) United States Patent
Kim et al.

(10) Patent No.: US 9,506,623 B2
(45) Date of Patent: Nov. 29, 2016

(54) SURFACE LIGHT-EMITTING UV LED LAMP AND MANUFACTURING METHOD THEREOF

(71) Applicant: Seoul Viosys Co., Ltd., Ansan-si (KR)

(72) Inventors: Jae-Jo Kim, Icheon-si (KR); Sun-Woong Shin, Anyang-si (KR)

(73) Assignee: SEOUL VIOSYS CO., LTD., Ansan-Si (KR)

( * ) Notice: Subject to any disclaimer, the term of this patent is extended or adjusted under 35 U.S.C. 154(b) by 0 days.

(21) Appl. No.: 14/852,133

(22) Filed: Sep. 11, 2015

(65) Prior Publication Data

US 2016/0076726 A1 Mar. 17, 2016

(30) Foreign Application Priority Data

Sep. 11, 2014 (KR) ..... 10-2014-0120467

(51) Int. Cl.

| | |
|---|---|
| ***F21V 7/10*** | (2006.01) |
| ***F21V 3/04*** | (2006.01) |
| ***B24C 1/00*** | (2006.01) |
| *F21Y 101/02* | (2006.01) |

(52) U.S. Cl.

CPC ..... *F21V 3/0436* (2013.01); *B24C 1/00* (2013.01); *F21V 3/0418* (2013.01); *F21Y 2101/02* (2013.01)

(58) Field of Classification Search

USPC ..... 250/493.1, 494.1, 504 R, 504 H

See application file for complete search history.

(56) References Cited

U.S. PATENT DOCUMENTS

| | | | | |
|---|---|---|---|---|
| 2005/0104004 | A1* | 5/2005 | Takeuchi | G01J 1/02 250/372 |
| 2008/0123711 | A1* | 5/2008 | Chua | H01L 33/405 372/50.11 |
| 2011/0176328 | A1* | 7/2011 | Anandan | G02B 6/0036 362/606 |
| 2012/0038984 | A1* | 2/2012 | Patel | G02B 5/124 359/530 |
| 2015/0266766 | A1* | 9/2015 | Dannoux | C03B 17/065 65/64 |

* cited by examiner

*Primary Examiner* — Nicole Ippolito

(74) *Attorney, Agent, or Firm* — Perkins Coie LLP

(57) ABSTRACT

The present disclosure relates to a UV LED lamp, and more particularly, to a UV LED lamp which converts UV LED light from a point light source into surface light using the simplest structure and emits the surface light. The UV LED lamp comprises: a UV LED chip; a PCB board having the UV LED chip mounted thereon; and a cover disposed at a distance from the UV LED chip and configured to convert point UV light, emitted from the UV LED chip, into surface light, the cover having an inner surface facing the UV LED chip and an outer surface opposite the inner surface, wherein the inner surface and outer surface of the cover are roughened, and the amount of total reflection from the roughened inner surface is greater than the amount of total reflection from the roughened outer surface.

19 Claims, 6 Drawing Sheets

SURFACE LIGHT-EMITTING UV LED LAMP AND MANUFACTURING METHOD THEREOF

CROSS REFERENCE TO RELATED APPLICATION

This application claims the benefit of Korean Patent Application No. 10-2014-0120467, filed on Sep. 11, 2014, entitled "SURFACE LIGHT-EMITTING UV LED LAMP AND MANUFACTURING METHOD THEREOF," which is hereby incorporated by reference in its entirety into this application.

TECHNICAL FIELD

The present disclosure relates to an ultraviolet light-emitting diode (UV LED) lamp. Some implementations of the disclosed technology provide a UV LED lamp which enables UV LED light from a point light source to be converted into surface light only by a simple component and structure, and to a manufacturing method thereof.

BACKGROUND

UV light sources are used for various purposes, including medical purposes such as sterilization and disinfection, purposes of analysis based on changes in irradiated UV light, industrial purposes such as UV curing, cosmetic purposes such as UV tanning, insect trapping, counterfeit money discrimination, etc.

Conventional UV light lamps used as such UV light sources include mercury lamps, excimer lamps, deuterium lamps, etc. However, such conventional lamps have problems in that they require a large amount of power, emit a large amount of heat, have a short life span, and cause environmental pollution due to toxic gas filled therein.

SUMMARY

Various implementations of the disclosed technology provide a UV LED lamp which is manufactured using transparent quartz or PMMA having good UV transmittance and which can emit surface light in a simple manner without having to use a complex structure.

Some implementations of the disclosed technology provide a UV LED lamp which can emit UV light while converting the light into surface light and increase the transmittance of light through the lamp.

According to the present disclosure, each of the inner surface and outer surface of a cover made of or including PMMA or quartz is roughened. In this case, the refraction and diffusion of UV light incident through the inner surface of the cover can be increased, and the UV light incident through the inner surface can further be refracted and diffused before it is emitted to the outside through the outer surface of the cover. Thus, it is ensured that the UV light from the point light source is converted into surface light.

According to some implementations of the present disclosure, the amount of reflection from the outer surface of the cover is smaller than the amount of reflection from the inner surface of the cover. In this case, the phenomenon that the UV light being emitted through the outer surface of the cover is reflected from the outer surface can be reduced, thereby increasing the UV transmittance of the cover, and the phenomenon that the UV light reflected from the outer surface of the cover is reflected again from the inner surface can be increased. Thus, the UV light can be incident again to the outer surface of the cover without being lost in the lamp, so that the loss of the UV light can be reduced while the point light source is converted into a surface light source.

In one aspect, a UV LED lamp is provided to comprise: a UV LED chip; a substrate having the UV LED chip mounted thereon; and a cover disposed apart by a distance from the UV LED chip and configured to convert point UV light, emitted from the UV LED chip, into surface light, the cover having an inner surface facing the UV LED chip and an outer surface opposite the inner surface, wherein the inner surface and outer surface of the cover are roughened, and the amount of total reflection from the roughened inner surface is greater than the amount of total reflection from the roughened outer surface.

In some implementations, a value ($T_0$) obtained by dividing a centerline average roughness ($Ra_0$) for roughness sampling length (L) by the mean width of profile elements ($Sm_0$) within the roughness sampling length (L) in the outer surface of the cover is smaller than a value ($T_1$) obtained by dividing a centerline average roughness ($Ra_1$) for roughness sampling length (L) by the mean width of profile elements ($Sm_1$) within the roughness sampling length (L) in the inner surface of the cover.

In some implementations, the value ($T_0$) and the value ($T_1$) satisfy $T_1>1.5T_0$.

In some implementations, the cover includes PMMA.

In some implementations, the PMMA includes an acrylic polymer containing 85-100 wt % of MMA monomer units.

In some implementations, the cover includes quartz.

In another aspect, a method for manufacturing a UV LED lamp cover is provided, which is disposed at a distance from a UV LED chip and is configured to convert point UV light, emitted from the UV LED chip, into surface light, and has an inner surface facing the UV LED chip and an outer surface opposite the inner surface. The method may comprise roughening the inner surface and outer surface of the cover such that a value ($T_0$) obtained by dividing a centerline average roughness ($Ra_0$) for roughness sampling length (L) by the mean width of profile elements ($Sm_0$) within the roughness sampling length (L) in the outer surface of the cover is smaller than a value ($T_1$) obtained by dividing a centerline average roughness ($Ra_1$) for roughness sampling length (L) by the mean width of profile elements ($Sm_1$) within the roughness sampling length (L) in the inner surface of the cover.

In some implementations, the cover includes PMMA, and the roughening is performed by extruding the cover and sandblasting the inner surface and outer surface of the extruded cover.

In some implementations, the cover includes PMMA, and the roughening is performed by providing a mold having a shape same as the cover, sandblasting surfaces of the mold, which correspond to the inner surface and outer surface of the cover, respectively, and injecting PMMA through the sandblasted mold to form the cover.

In some implementations, the cover includes quartz, and the roughening is performed by forming quartz into a shape same as the cover, and sandblasting the inner surface and outer surface of the formed cover.

In some implementations, the speed of blasting of abrasive particles to the inner surface of the cover is higher than the speed of blasting of abrasive particles to the outer surface.

In some implementations, the inner surface and outer surface of the cover are sandblasted with the same abrasive particle group.

In some implementations, the average particle diameter of the abrasive particle group used in the sandblasting of the inner surface of the cover is smaller than that of the abrasive particle group used in the sandblasting of the outer surface of the cover.

In some implementations, the roughening is performed by chemical treatment.

In some implementations, the value ($T_0$) and the value ($T_1$) satisfy $T_1>1.5T_0$.

DETAILED DESCRIPTION

Figure 1:
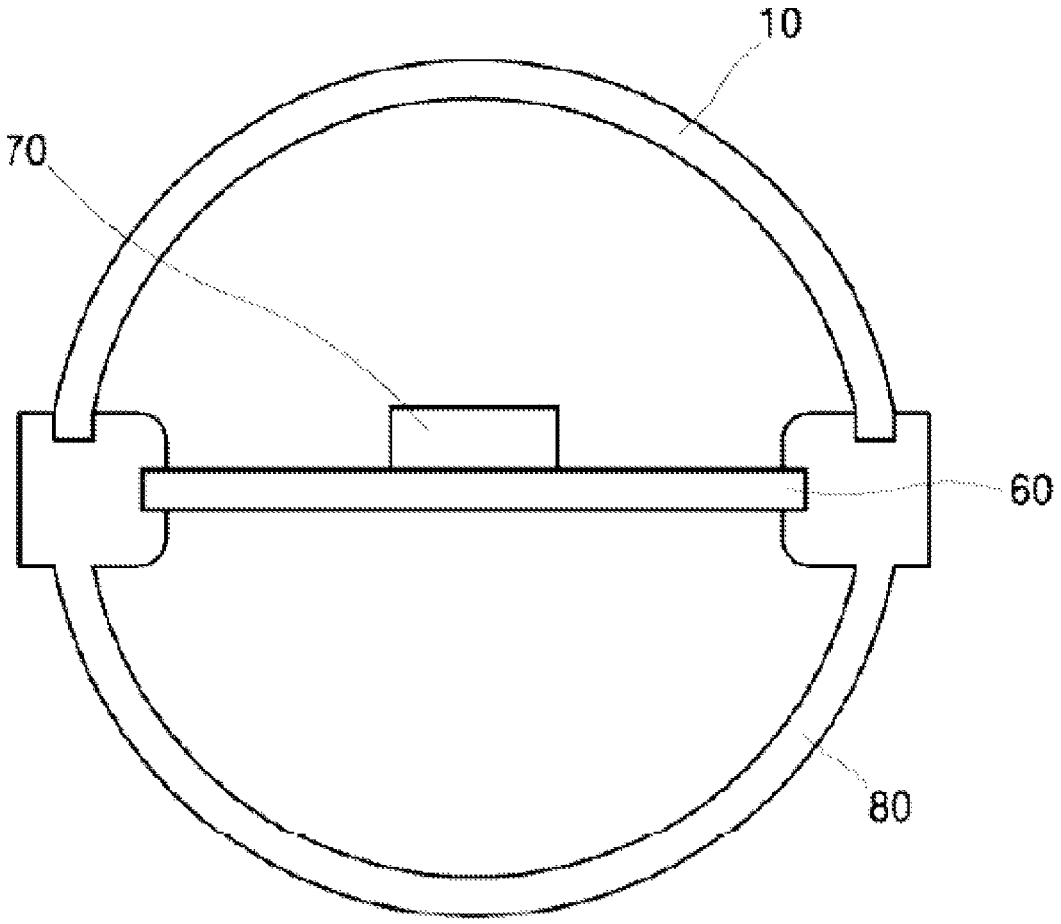
FIG. 1 is a cross-sectional view showing an embodiment of a UV LED lamp according to the present disclosure.

There have been made various efforts to address the problems of the conventional UV light lamps that have been discussed above. UV LEDs have advantages in that they require less power and cause no environmental pollution. However, the production cost of LED packages that emit light in the UV range is significantly higher than that of LED packages that emit light in the visible range. Further, various products comprising LED packages that emit UV light have not been developed due to the characteristics of UV light.

For example, the following considerations should be taken into account when manufacturing a lamp product comprising a UV LED. One of the considerations is associated with a lamp cover. To manufacture a lamp comprising a UV LED chip, a lamp cover made of a material suitable for covering and protecting the UV LED chip while transmitting UV light is required. If quartz (glass) is used for the lamp cover, it can transmit UV light having a short wavelength, but there are problems in that it requires caution in handling due to its brittleness and has very low formability and poor heat dissipation performance. As a substitute for quartz, a polymer can be conceived, which has better formability and durability and is easy to handle, compared to quartz. However, the polymer has a significantly low light transmittance, because an electron cloud, which is present around the atomic nucleus in the polymer molecule and which has a resonant frequency corresponding to that of UV light, absorbs light having a wavelength of 400 nm or less (UV wavelength region). In addition, the polymer material deteriorates by UV light. For these reasons, it is not proper to use the polymer as the lamp cover. However, it is known that pure PMMA (poly methyl methacrylate) has high transmittance, because it consists mainly of carbon and hydrogen atoms and has a thin electron cloud.

The second consideration is associated with the light emission characteristic of LEDs. Pure PMMA as mentioned above is a transparent material, and for this reason, when it is used as a transparent cover for a UV LED lamp, the light source and circuit units of the UV LED lamp are exposed to the outside, making the appearance of the lamp poor. In addition, it is difficult to achieve uniform lighting, because the light source region looks particularly brighter due to the light emission characteristic of LEDs. If LEDs are arranged more densely in order to achieve uniform lighting, there is a problem in that the price of the UV LED lamp further increases because of the high price of the UV LED package.

In addition, if a UV LED lamp is used as an insect trapping lamp, there is a problem in that the effect of attracting insects is reduced by hot spots. Furthermore, in industrial applications such as UV curing or cosmetic applications such as tanning, a uniform UV surface light source is more preferable than point light sources, and thus the demand for the conversion of UV LED lamps into surface light sources is increasing.

In view of these points, it can be said that the conversion of UV LED lamps from point light sources into surface light sources may significantly enlarge the field of application of UV LED lamps.

Meanwhile, technologies of converting visible LED point light sources into surface light sources are already known. In most of these technologies, point light sources or linear light sources are converted into surface light sources using diffusion materials such as light guide panels, diffusion sheets or films. However, even when such technologies are applied to UV LEDs, there are problems in that conventional polycarbonate (PC)-based diffusion materials absorb UV light to significantly reduce the amount of UV light emitted to the outside and in that UV light causes rapid deterioration of diffusion materials rapid such as yellowing them, and thus the light source cannot be used due to discoloration or deterioration of the diffusion materials.

In addition, if a structure such as a diffusion sheet or a light guide panel, which has been used to convert the point light source LED (which is used for LED backlights for TVs) into a surface light source, is applied to simple LED lamps, there are problems in that the applied structure makes the structure of the lamp unnecessarily complex and increase the production cost of the lamp, indicating that replacement of conventional UV lamps with UV LED lamps is insignificant.

Under the recognition above, exemplary embodiments of the disclosed technology will be described below with reference to the accompanying drawings. The disclosure may, however, be embodied in different forms and should not be constructed as limited to the embodiments set forth herein. Throughout the disclosure, like reference numerals refer to like parts throughout the various figures and embodiments of the disclosure.

FIG. 1 is a cross-sectional view showing an embodiment of a UV LED lamp according to the present disclosure. As shown therein, the UV LED lamp according to the present disclosure comprises: a UV LED 70; a PCB board 60 having the UV LED chip 70 mounted thereon; a housing 80 configured to support the PCB board 60 and including a heat sink and an electrical control circuit; and a cover 10 supported by the housing and configured to cover the UV LED chip at a distance from the UV LED chip.

This UV LED lamp may be in the form of a bar such as a fluorescent lamp, or a glow lamp such as a bulb.

The cover 10 is made of or includes a material which is transparent and has high UV transmittance at the same time. In a preferred embodiment, the cover 10 is made of or includes PMMA. It was found that a nearly pure acrylic polymer having a very low content of additives, such as an acrylic polymer containing 85-100 wt % of methylmethacrylate (MMA) monomer units, has better UV transmittance.

However, a special acrylic polymer (PMMA) having increased transmittance does not have better formability than conventional polymers, and thus a process for manufacturing the cover using the same can be more complex than a process for manufacturing the cover using conventional polymers. However, this acrylic polymer is very suitable as a cover material for a UV LED lamp in that it has high transmittance and is easy to handle because it has high strength and is not easily broken.

In addition, quartz can also be selected as a material for the cover. Quartz is ideal in that it has high light transmittance in any wavelength region, although it is difficult to manufacture into the cover and requires caution in handling due to its very high brittleness, compared to polymers.

Figure 2:
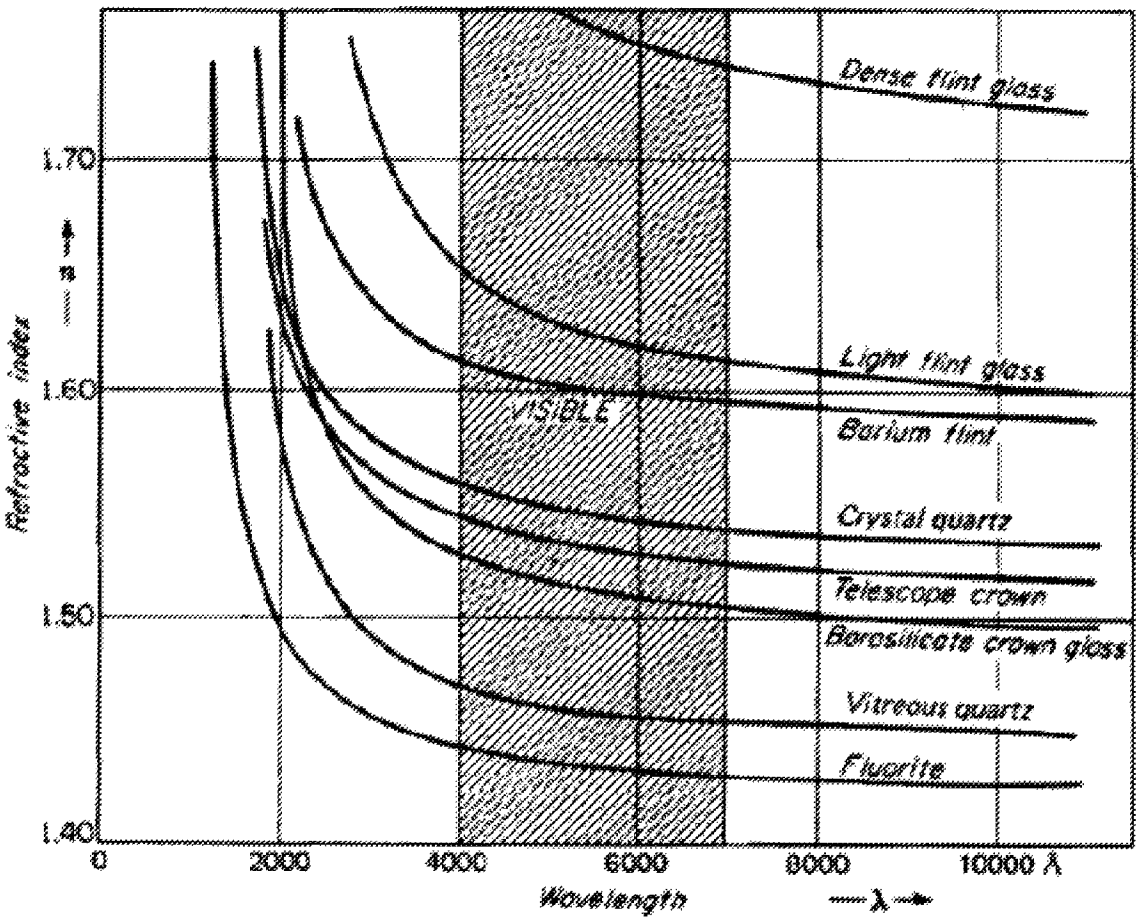
FIG. 2 is a diagram showing the refractive indices of various materials as a function of the wavelength of light.

Meanwhile, unlike the case of the visible wavelength range, according to the present disclosure, a point light source can be converted into a surface light source by roughening the cover as described below without using a structure such as a diffusion sheet. As shown in FIG. 2 that is a diagram showing the refractive indices of various materials as a function of the wavelength of light, this possible conversion into the surface light source is based on the phenomenon that the refractive index of any material increases as the wavelength of light passing through the material decreases and that the rate of increase in the refractive index increases abruptly as the wavelength becomes shorter. In other words, possible conversion of a UV light source into a surface light source by sanding of the cover itself without the use of a separate structure or component is based on the fact that UV light has a very short wavelength, and thus has a considerably high refractive index.

However, due to such properties of UV light, new difficulty was encountered in converting a UV light source into a surface light source. That is, the efficiency with which UV light passes through the roughened surface was significantly lower in the UV wavelength range than in the visible wavelength range. This is because the critical angle at which total reflection starts to occur gradually decreases as the refractive index increases. In other words, UV light has a high refractive index due to its short wavelength, and thus is easily reflected. As a result, it was found that, when UV light was passing through the outer surface of the roughened cover, a large amount of reflection occurred, and thus the transmission of the light decreased.

It is to be noted that the phenomenon that the refractive index increases in the UV light range has an advantage in that conversion into a surface light source is somewhat possible by sanding both surfaces of the cover without using any separate component, but has a disadvantage in that the ratio of light reflected when UV light is reflected from the cover to the outside increases, resulting in an increase in the loss of the light.

With respect to this phenomenon, according to the present disclosure, two issues (conversion into a surface light source, and high transmittance efficiency) have been achieved by the method described below.

Figure 3:
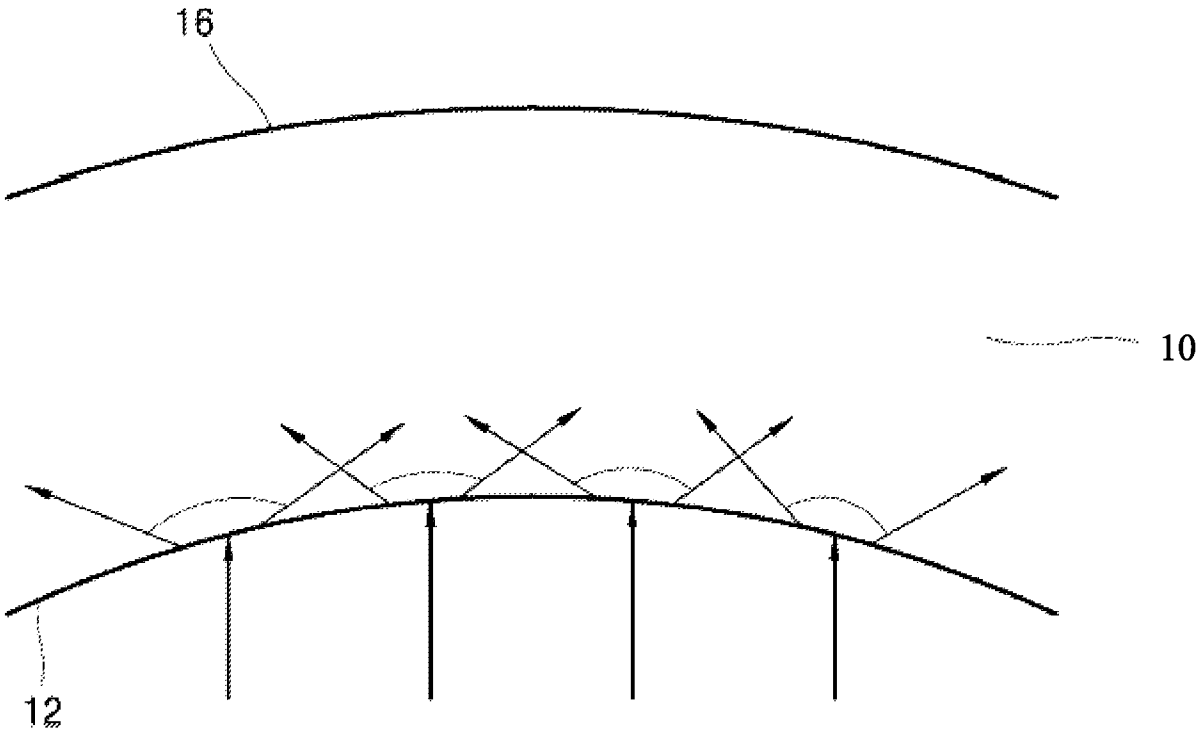
FIG. 3 is an enlarged view of a lamp cover of the present disclosure, and shows a state in which UV light is incident on the inner surface of the cover.
Figure 4:
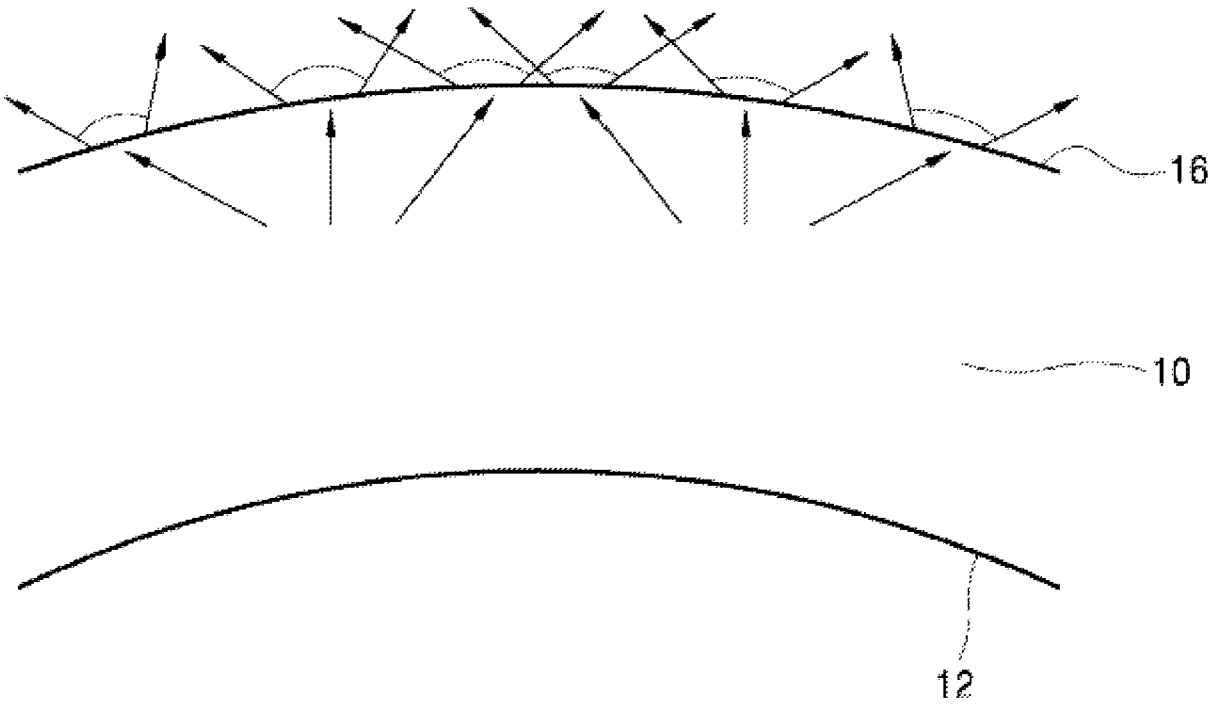
FIG. 4 is an enlarged view of a lamp cover of the present disclosure, and shows a state in which UV light is incident to the outer surface of the cover and emitted from the cover.
Figure 5:
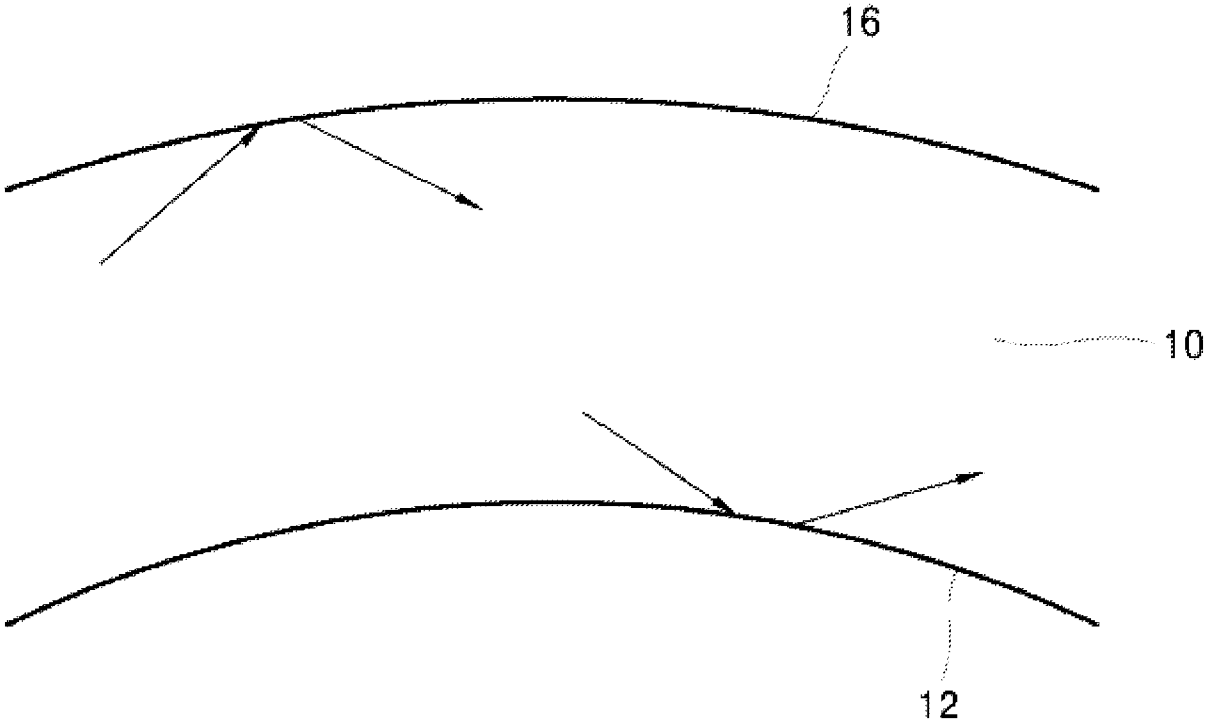
FIG. 5 schematically shows that reflection from the inner surface and outer surface of a lamp cover of the present disclosure occurs.

FIG. 3 is an enlarged view of a lamp cover of the present disclosure, and shows a state in which UV light is incident on the inner surface of the cover; FIG. 4 is an enlarged view of a lamp cover of the present disclosure, and shows a state in which UV light is incident to the outer surface of the cover and emitted from the cover; and FIG. 5 schematically shows that reflection from the inner surface and outer surface of a lamp cover of the present disclosure.

Referring to FIG. 3, the UV LED lamp cover 10 according to the present disclosure comprises: an inner surface 12 facing the UV LED chip 70; an outer surface 16 facing the outside of the lamp; and a medium between the inner surface and the outer surface.

First, UV light emitted from the UV LED chip 70 is incident to the cover 10 through the inner side 12 of the cover 10. The inner surface of the cover is roughened such that it is configured as shown in FIGS. 6(*a*)-6(*c*). Thus, the UV light incident through the inner surface 12 is irregularly refracted as shown in FIG. 3 by the shape of the inner surface having a certain roughness, as if it is scattered or diffused.

Next, the UV light incident through the inner surface 12 passes through the medium of the cover 10, and reaches the outer surface 16 as shown in FIG. 4. Because the outer surface 16 is also roughened as shown in FIGS. 6(*a*)-6(*c*), the UV light that has reached the outer surface 16 is further scattered, refracted and emitted as shown in FIG. 4, indicating that it is diffused again.

In addition to the fact that the inner surface 12 and outer surface 16 of the cover 10 are roughened in order to convert a UV point light source into a surface light source, the present disclosure is characterized in that the degree of reflectivity of light on the two surfaces is adjusted to reduce the loss of UV transmittance in order to reduce the loss of UV light that occurs when the light is converted into surface light in the roughened cover 10. In other words, the cover 10 according to the present disclosure is configured such that when UV light is to come out of the cover 10 that is a dense medium, reflection from the outer surface 16 of the cover 10 decreases and reflection from the inner surface 12 increases, whereby the amount of UV light coming out of the outer surface 16 from the medium of the cover 10 is increased, and the amount of UV light reflected from the outer surface 16 as shown in FIG. 5 is reduced, and the UV light reflected from the outer surface 16 to the inner surface 12 is reflected again from the inner surface 12 to the outer surface 16 as shown in FIG. 5, thereby increasing the transmission of the UV light.

FIGS. 6(*a*)-6(*c*) are enlarged views of the shapes of surfaces roughened according to the present disclosure. Hereinafter, a method of quantitatively or qualitatively analyzing the degree of reflection depending on the degree of roughness of roughened surfaces according to the present disclosure and a method for increasing the transmittance of UV light will be described with reference to FIGS. 6(*a*)-6(*c*).

Prior to this, the concept of centerline average roughness (Ra) needs to be described in brief and will now be described in brief.

The contour of the surface to be measured, which appears in a cross-section obtained when the surface to be measured is cut vertically to the average surface of the surface to be measured, is referred to as the profile which has a curve shape as shown in FIGS. 6(*a*)-6(*c*).

In addition, in a portion surrounded by the profile and a straight line drawn parallel to the average profile within the roughness sampling length (L), a curve in which the area of a portion (peak) above the straight line and the area of a portion (valley) under the straight line are equal to each other is referred to as the graphical centerline which is equal to the centerline (C) shown in FIGS. 6(*a*)-6(*c*).

As used herein, the term "roughness sampling length (L)" refers to a reference length determined to calculate the average of roughness.

As shown in FIGS. 6(*a*)-6(*c*), a value obtained by dividing the sum of the area of peaks and the area of valleys by the roughness sampling length (L) is the centerline average roughness (Ra) and is given in units of μm (micrometer).

Meanwhile, the term "roughness spacing" refers to the mean spacing between adjacent peaks, obtained when measuring roughness within the roughness sampling length (L). It is mainly expressed as the mean width of profile elements (Sm). As shown in FIGS. 6(*a*)-6(*c*), it is a value obtained by averaging the sum of the distances from a point at which one peak (valley) crosses the centerline (C) to the corresponding point of a point adjacent thereto, and is given in units of mm (millimeter).

This centerline average roughness (Ra) does not give information about the profile of roughness. For example, FIG. 6(*c*) shows a waveform, and in FIG. 6(*c*), a profile having a width of ½ compared to that in FIG. 6(*a*) is repeated twice. In this case, the centerline average roughness (Ra) in FIG. 6(*c*) is equal to that in FIG. 6(*a*). However, the mean width of profile elements (Sm) in FIG. 6(*c*) is ½ of that in FIG. 6(*a*).

Meanwhile, referring to FIG. 6(*b*), the mean width of profile elements (Sm) in FIG. 6(*b*) is equal to that in FIG. 6(*a*), but the mean height in FIG. 6(*b*) is ⅓ of that in FIG. 6(*a*), and thus the centerline average roughness (Ra) in FIG. 6(*b*) is also ⅓ of that in FIG. 6(*a*).

When light is incident on the boundary between the dense medium and the sparse medium, total reflection occurs if the incident angle of the light is greater than the critical angle thereof. In addition, light incident on the boundary between the dense medium and the sparse medium is partially reflected even when the incident angle is not greater than the critical angle. In other words, as light is inclinedly incident on the boundary of the medium, reflection easily occurs, and as light is vertically incident on the boundary of the medium, reflection hardly occurs.

According to the present disclosure, it can be seen that UV light reaches the boundary of the medium while it is scattered in various directions, but when seeing the light on average, reflection from the boundary form as shown in FIG. 6(*c*) is more than reflection from the boundary form as shown in FIG. 6(*b*). In other words, it can be said that, as the slope of the profile of roughness increases, reflection from the boundary between the dense medium and the sparse medium increases.

Thus, in the outer surface and inner surface of the roughened cover, as the profile of roughness of the outer surface more resembles that in FIG. 6(*b*) and as the profile of roughness of the inner surface more resembles that in FIG. 6(*c*), reflection from the outer surface decreases and reflection from the inner surface increases.

The results of analysis of the profiles shown in FIGS. 6(*a*)-6(*c*) can be summarized in Table 1 below.

TABLE 1

Figure 6A:
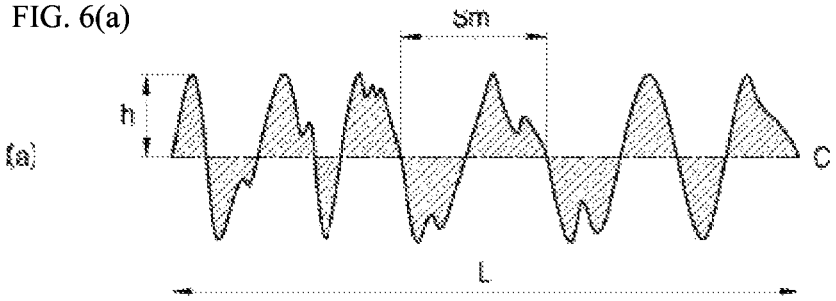
FIGS. 6(*a*)-6(*c*) are enlarged views of a surface roughened according to the present disclosure.
Figure 6B:
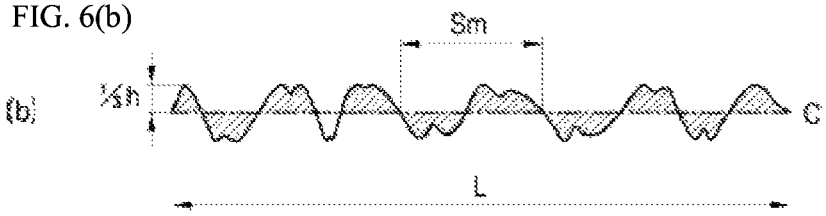
Figure 6C:
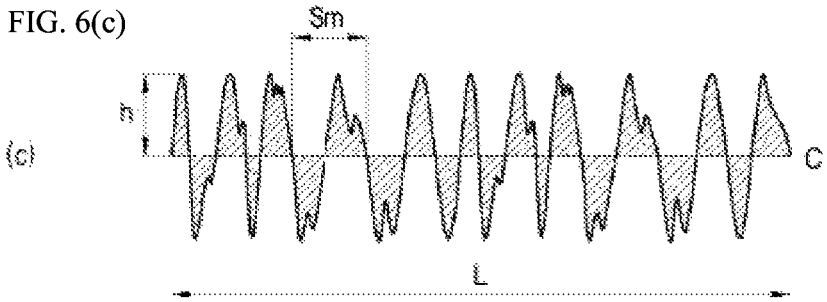

| | Ra | Sm | T = Ra/Sm |
|---|---|---|---|
| Profile in FIG. 6(a) | R | S | R/S |
| Profile in FIG. 6(b) | R/3 | S | (1/3)*(R/S) |
| Profile in FIG. 6(c) | R | S/2 | 2*(R/S) |

In Table 1 above, "T" may be a value representing the slope of the profile of roughness. In other words, as the T value increases, the slope increases, and thus reflection from the boundary between the dense medium and the sparse medium increases.

As described above, the reflectivity of light incident on the roughened surface from dense medium and to sparse medium is associated directly with the slope, and thus it can be seen that the reflectivity of the roughened surface cannot be represented by only anyone value of the centerline average roughness (Ra) and the mean width of profile elements (Sm), is proportional to the centerline average roughness (Ra), and is inversely proportional to the mean width of profile elements (Sm) ($T \propto Ra/Sm$).

Thus, as the centerline average roughness (Ra) of the inner surface (12) is greater than that of the outer surface (16) and as the mean width of profile elements (Sm) of the inner surface 12 is narrower than that of the outer surface 16, the UV transmittance of the cover increases.

The foregoing has been described on the assumption that the profiles do not have a step shape, but have a shape like a waveform. If physical or chemical roughening at a level (several to several hundred micrometers) for diffusion of light is performed, profiles resembling a waveform will always be formed. Thus, this assumption is consistent with actual practices.

Hereinafter, methods of surface roughening process so as to satisfy the above-described conditions will be described.

Sanding is a process in which sanding particles or abrasive particles are blasted onto the surface of a workpiece at high speed so as to collide with the surface so that marks caused by collision of the particles will remain, thereby forming a certain roughness on the surface.

The present disclosure is characterized by the inner surface 12 and outer surface 16 of the cover 10 are sanded with the same abrasive particles, wherein the blasting speed in the sanding of the inner surface is greater than the blasting speed in the sanding of the outer surface so that the surface roughness will be different between the two surfaces. Particularly, it can be seen that, when the inner and outer surfaces are processed with abrasive particles at different blasting speeds, as shown in FIGS. 6(*a*) and 6(*b*), the spacing between roughness elements is substantially the same between the two surfaces while the height of peaks and the depth of valleys are different between the two surfaces.

In other words, in the case of the cover inner surface 12 sandblasted at a relatively high speed, as shown in FIG. 6(*a*), the centerline average roughness (Ra) for the same mean width of profile elements (Sm) is relatively great, and thus the slope of the profile is relatively large, whereas in the case of the outer surface 16 sandblasted at a relatively low speed, as shown in FIG. 6(*b*), the centerline average roughness (Ra) for the same mean width of profile elements (Sm) is relatively small, and thus the slope of the profile is relatively small.

In the case in which the cover 10 is manufactured as described above, the slope angle of the outer surface 16 of the cover 10 is smaller than that of the inner surface 12, and thus the light reflectivity of the outer surface 16 is relatively low. Also, when light reflected without passing through the outer surface 16 is incident again to the inner surface 12, it is reflected again from the inner surface 12 by a greater slope angle formed on the inner surface 12, and thus the extent to which the light reflected from the outer surface 16 is reflected again toward the outer surface 16 increases, thereby increasing the transmittance of the UV light passing through the cover 10.

In addition, according to the present disclosure, in the process of sanding the inner surface 12 and outer surface 16 of the cover 10, the average particle diameter of an abrasive particle group for sanding the outer surface 16 can be greater than that of an abrasive particle group for sanding the inner surface 12 so that the mean width of profile elements (Sm) of the outer surface 16 will be greater than that of the inner surface 12, thereby controlling the reflectivity of the cover 10.

If the cover 10 is roughened as described above, the outer surface 16 can be configured as shown in FIG. 6(*a*) while the inner surface 12 can be configured as shown in FIG. 6(*c*). Thus, the UV transmittance of the cover 10 can be increased.

In addition, if the blasting speed in sanding of the outer surface 16 is lower than the blasting speed used in sanding of the inner surface 12, the outer surface can be configured as shown in FIG. 6(*b*) and the inner surface can be configured as shown in FIG. 6(*c*). In this case, the UV transmittance of the cover can further be increased.

In other words, when the average particle diameter of the abrasive particle group and the blasting speed of the abrasive particle group, which are applied in the sanding process as described, are different between the inner surface and the outer surface, the difference in T value between the inner surface and the outer surface can be increased.

In addition, the inner surface and outer surface of a cover manufactured by extrusion or the like can be directly sandblasted. Alternatively, when an injection mold for manufacturing the cover is sandblasted and injection molding is performed using the injection mold, an indirectly roughened cover can be produced.

In addition, other cost-effective methods, for example, chemical treatment such as chlorine treatment, can also be used to form a roughened surface.

Meanwhile, a cover made of PMMA was manufactured using S-O or S-O-L acryl (Nitto Co., Ltd.; produced between April 2014 and June 2014) and sanded to varying degrees, and the UV transmittances of the sanded covers were measured. The results of the measurement are shown in Table 2 below.

TABLE 2

| | Example 1 | Example 2 | Example 3 | Example 4 |
|---|---|---|---|---|
| T (relative value) (roughness sampling length: 0.8 mm) | Not sanded | Inner surface $T_2$ Outer surface $T_2$ | Inner surface $T_3$ Outer surface 2.5 $T_3$ | Inner surface 2.5 $T_4$ Outer surface $T_4$ |
| UV transmittance | 93% | 80% | 75% | 83% |

As can be seen in Table 2 above, the sanded cover had low UV transmittance compared to the non-sanded cover, but in the case in which the T value of the inner surface was greater than that of the outer surface, the light transmittance was higher than that in the case in which the T value of the outer surface is greater than that of the inner surface.

In addition, a cover was manufactured using quartz having a composition of 75.0% $SiO_2$, 11.0% $B_2O_3$, 5.4% $Al_2O_3$ and 6.5% $Na_2O_3$, a density of 2.31-2.32 g/cm$^3$ and an AT (annealing point logη=13° C./annealing temperature) and ST (softening point logη=7.6° C./softening temperature) of 779-783° C., in place of PMMA, and the manufactured cover was sanded to varying degrees. The UV transmittances of the sanded covers were measured, and the results of the measurement are shown in Table 3.

TABLE 3

| | Example 5 | Example 6 | Example 7 | Example 8 |
|---|---|---|---|---|
| T (relative value) (roughness sampling length: 0.8 mm) | Not sanded | Inner surface $T_6$ Outer surface $T_6$ | Inner surface $T_7$ Outer surface 2.1 $T_7$ | Inner surface 2.2 $T_8$ Outer surface $T_8$ |
| UV transmittance | 97% | 85% | 81% | 88% |

As can be seen in Table 3 above, like the case of PMMA, the sanded cover had low UV transmittance compared to the non-sanded cover, but in the case in which the T value of the inner surface was greater than that of the outer surface, the light transmittance was higher than that in the case in which the T value of the outer surface is greater than that of the inner surface.

Thus, it can be seen that, when the T value ($T_0$) of the outer surface is smaller than the T value ($T_1$) of the inner surface, the transmittance of UV light is increased regardless of the kind of material.

In addition, according to the present disclosure, the inner surface and outer surface of the cover may be sanded such that the T value of the inner surface is theoretically greater than that of the outer surface. However, the results of the experiment indicate that, when the cover is sanded such that the T value of the inner surface is at least 1.5 times greater than that of the outer surface in view of the error of manufacture and the error of measurement, the light transmittance of the cover can be increased without an error resulting from the error of manufacture and measurement.

To manufacture a PMMA cover, a method of manufacturing a cover by sandblasting a mold and performing injection molding using the sandblasted mold may be used. Alternatively, a method may be used which comprises extruding a cover in a semi-tube form and sandblasting each of the inner surface and outer surfaces of the cover. In addition, as described above, it is also possible to process the surface by chemical treatment. That is, it is possible to chemically treat an injection mold itself, followed by injection molding, or to chemically treat an extruded cover.

As described above, according to the present disclosure, the cover itself can act as a diffusion sheet without a separate component for converting a point light source, and thus the point light source can be reliably converted into a surface light source while the structure of the lamp can be simplified. In addition, the UV transmittance of the UV LED lamp can be maximized, and thus the range of application of the UV LED lamp can be greatly expanded.

While various embodiments have been described above, it will be understood to those skilled in the art that the embodiments described are by way of example only. Accordingly, the disclosure described herein should not be limited based on the described embodiments.

What is claimed is:

1. A UV LED lamp comprising:

a UV LED chip;

a substrate having the UV LED chip mounted thereon; and a cover disposed apart by a distance from the UV LED chip and configured to convert point UV light, emitted from the UV LED chip, into surface light, the cover having an inner surface facing the UV LED chip and an outer surface opposite the inner surface, wherein the inner surface and outer surface of the cover are roughened, and the amount of total reflection from the roughened inner surface is greater than the amount of total reflection from the roughened outer surface.

2. The UV LED lamp of claim 1, wherein a value ($T_0$) obtained by dividing a centerline average roughness ($Ra_0$) for roughness sampling length (L) by the mean width of profile elements ($Sm_0$) within the roughness sampling length (L) in the outer surface of the cover is smaller than a value ($T_1$) obtained by dividing a centerline average roughness ($Ra_1$) for roughness sampling length (L) by the mean width of profile elements ($Sm_1$) within the roughness sampling length (L) in the inner surface of the cover.

3. The UV LED lamp of claim 2, wherein the value ($T_0$) and the value ($T_1$) satisfy $T_1>1.5T_0$.

4. The UV LED lamp of claim 1, wherein the cover includes PMMA.

5. The UV LED lamp of claim 4, wherein the PMMA includes an acrylic polymer containing 85-100 wt % of MMA monomer units.

6. The UV LED lamp of claim 1, wherein the cover includes quartz.

7. A method for manufacturing a UV LED lamp cover which is disposed apart by a distance from a UV LED chip and is configured to convert point UV light, emitted from the UV LED chip, into surface light, and has an inner surface facing the UV LED chip and an outer surface opposite the inner surface, the method comprising roughening the inner surface and outer surface of the cover such that a value ($T_0$) obtained by dividing a centerline average roughness ($Ra_0$) for roughness sampling length (L) by the mean width of profile elements ($Sm_0$) within the roughness sampling length (L) in the outer surface of the cover is smaller than a value ($T_1$) obtained by dividing a centerline average roughness ($Ra_1$) for roughness sampling length (L) by the mean width of profile elements ($Sm_1$) within the roughness sampling length (L) in the inner surface of the cover.

8. The method of claim 7, wherein the cover includes PMMA, and the roughening is performed by extruding the cover and sandblasting the inner surface and outer surface of the extruded cover.

9. The method of claim 8, wherein the speed of blasting of abrasive particles to the inner surface of the cover is higher than the speed of blasting of abrasive particles to the outer surface.

10. The method of claim 9, wherein the inner surface and outer surface of the cover are sandblasted with the same abrasive particle group.

11. The method of claim 8, wherein the average particle diameter of an abrasive particle group used in the sandblasting of the inner surface of the cover is smaller than the average particle diameter of an abrasive particle group used in the sandblasting of the outer surface of the cover.

12. The method of claim 11, wherein the speed of blasting of abrasive particles to the inner surface of the cover is higher than the speed of blasting of abrasive particles to the outer surface.

13. The method of claim 7, wherein the cover includes PMMA, and the roughening is performed by providing a mold having a shape same as the cover, sandblasting surfaces of the mold, which correspond to the inner surface and outer surface of the cover, respectively, and injecting PMMA through the sandblasted mold to form the cover.

14. The method of claim 7, wherein the cover includes quartz, and the roughening is performed by forming quartz into a shape same as the cover, and sandblasting the inner surface and outer surface of the formed cover.

15. The method of claim 14, wherein the speed of blasting of abrasive particles to the inner surface of the cover is higher than the speed of blasting of abrasive particles to the outer surface.

16. The method of claim 15, wherein the inner surface and outer surface of the cover are sandblasted with the same abrasive particle group.

17. The method of claim 14, wherein the average particle diameter of an abrasive particle group used in the sandblasting of the inner surface of the cover is smaller than the average particle diameter of an abrasive particle group used in the sandblasting of the outer surface of the cover.

18. The method of claim 7, wherein the roughening is performed by chemical treatment.

19. The method of claim 7, wherein the value ($T_0$) and the value ($T_1$) satisfy $T_1>1.5T_0$.

* * * * *